US010123143B2

(12) United States Patent
Parupalli et al.

(10) Patent No.: US 10,123,143 B2
(45) Date of Patent: Nov. 6, 2018

(54) CORRECTION FOR SPEAKER MONITORING

(71) Applicant: Cirrus Logic International Semiconductor Ltd., Edinburgh (GB)

(72) Inventors: Vamsikrishna Parupalli, Austin, TX (US); Lingli Zhang, Austin, TX (US); Jeremy Babcock, Austin, TX (US); Marc L. Tarabbia, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 0 days.

(21) Appl. No.: 15/276,437

(22) Filed: Sep. 26, 2016

(65) Prior Publication Data

US 2018/0091911 A1 Mar. 29, 2018

(51) Int. Cl.
*H04R 29/00* (2006.01)
*H04R 3/00* (2006.01)

(52) U.S. Cl.
CPC ..... *H04R 29/001* (2013.01); *H04R 3/007* (2013.01)

(58) Field of Classification Search
CPC ..... H04R 29/001; H04R 29/00; H04R 3/007
See application file for complete search history.

(56) References Cited

U.S. PATENT DOCUMENTS

| | | | | |
|---|---|---|---|---|
| 5,542,001 | A | 7/1996 | Reiffin | |
| 8,182,139 | B2 | 5/2012 | Fiennes et al. | |
| 2004/0178852 | A1 | 9/2004 | Neunaber | |
| 2009/0087725 | A1 | 4/2009 | Sim | |
| 2014/0169571 | A1 | 6/2014 | Polleros | |
| 2016/0105746 | A1* | 4/2016 | Berthelsen | H04R 3/007 381/55 |
| 2016/0182998 | A1* | 6/2016 | Galal | H03F 1/523 381/55 |
| 2017/0085986 | A1* | 3/2017 | Tang | H04R 3/007 |

* cited by examiner

*Primary Examiner* — Andrew L Sniezek
(74) *Attorney, Agent, or Firm* — Norton Rose Fulbright US LLP

(57) ABSTRACT

Errors in measurements of a resistor to monitor current through a speaker may be corrected to improve the accuracy, performance, or quality of other signals affected by the measurement. Error may occur in the current measurement resulting from variations in measurements involving the resistor, such as errors based on the sense resistor's response to temperature or voltage differential. Correcting the measurement errors can prevent the overcurrent condition from occurring, and otherwise improve audio output from the speaker. Thus, a method for correcting measurements in a speaker monitoring circuit may include monitoring a current through a speaker by receiving a measurement that is correlated to the current output through the speaker; and correcting the measurement for one or more inaccuracies in the measurement.

17 Claims, 6 Drawing Sheets

CORRECTION FOR SPEAKER MONITORING

FIELD OF THE DISCLOSURE

The instant disclosure relates to audio devices. More specifically, portions of this disclosure relate to monitoring currents through transducers.

BACKGROUND

Electronic components behave differently under different conditions. The movement of electrons that make up current flow through electronic components changes, for example, with temperature of the components. Although the variations in electronic components with respect to certain conditions may be small, those small differences may have a noticeable impact on the performance and/or output of those electronic components. One example of an electronic component that changes with changing temperature is a resistor. FIG. 1 is a graph illustrating error in measurements involving an example conventional resistor as a function of temperature. A graph 100 illustrates a percent (%) error in a measurement on a y-axis 102 as a function of temperature on an x-axis 104. A line 112 shows variation of a resistance measurement for an example resistor as a function of temperature. If a resistance measurement is performed at a high temperature, such as approximately 125 degrees Celsius, an error of about 0.4% may be incorporated into the resistance measurement. Any calculation that uses the resistance measurement value will also have error proportional to the resistance measurement error. Thus, the error propagates through later calculations and can cause significant problems with operation of certain circuitry.

Shortcomings mentioned here are only representative and are included simply to highlight that a need exists for improved electrical components, particularly for components employed in consumer-level devices such as mobile phones and techniques to compensate for these shortcomings. Embodiments described herein address certain shortcomings but not necessarily each and every one described here or known in the art.

SUMMARY

Errors in measurements of components may be corrected, which may improve the accuracy, performance, or quality of other signals affected by the measurement. For example, a resistor may be used to measure a current through a component, and that measured current used to control a device. In some embodiments, the measured current is a current through a transducer, such as a speaker in a mobile device, and that measured current used to control audio signals being played back through the speaker. Errors in the current measurement may occur due to inaccuracies in the current measurement, wherein the inaccuracies are errors in the reported current measurement due to conditions that cause the response of components involved in the current measurement to deviate from ideal response for those components. These errors, such as described above and with reference to FIG. 1, may cause errors in later computations based on the erroneous measurements and distort the speaker output. For example, in some embodiments, an apparatus may include speaker protection capability in which the speaker may be controlled to protect the speaker from over-current conditions by examining current measurements over a recent period of time. Errors in the current measurements may cause a mobile device to underestimate current through the speaker and thus allow an overcurrent condition to occur and damage the speaker. Correcting the measurement errors can prevent the overcurrent condition from occurring to protect the speaker, and improve audio output from the speaker to improve user experience. Thus, a method for correcting measurements in a speaker monitoring circuit may include monitoring a current through a speaker by receiving a measurement from an electronic component (e.g., a resistor) that is correlated to the current output through the speaker; and correcting the measurement for one or more inaccuracies in the measurement. The corrected measurement may then be used for speaker protection, which may allow the speaker to be operated closer to full capacity by reducing the necessary safety margin in current limits applied to the speaker.

In some embodiments, variations in a component, such as a sense resistor, may be due to temperature of the component. As described with reference to FIG. 1 above, temperature can cause variations in measurements. A measured value can be corrected based, in part or in whole, on a known temperature of the component and/or a known mathematical relationship for variations of the component with temperature. The correction may include applying compensation for non-linearity of a sense resistor used to obtain the received measurement due to temperature changes. The correction may include measuring fixed currents through the resistor across different operating temperatures, wherein the fixed currents have known expected voltage values; comparing the measured fixed currents with known expected voltage values; generating a mathematical relationship for variations of the sense resistor across the different operating temperatures of the sense resistor based, at least in part, on the comparing step; and compensating for the variations based, at least in part, on the generated mathematical relationship.

In some embodiments, variations in a component, such as a sense resistor, may be due to voltage differentials across the component. A voltage differential across a component can cause variations in measurements involving the component. A measured value can be corrected based, in part or in whole, on a known voltage differential across the component and/or a known mathematical relationship for variations of a component with voltage differential. The correction may include applying compensation for non-linearity of a sense resistor used to obtain the received measurement due to voltage differences across the sense resistor. The correction may include measuring actual voltages across the sense resistor across different currents, wherein the different currents have known expected voltage values; comparing the measured actual voltages with the known expected voltage values; generating a mathematical relationship for variations of the sense resistor across the different currents through the sense resistor based, at least in part, on the comparing step; and compensating for the variations based, at least in part, on the generated mathematical relationship.

In some embodiments, variations in a component, may be corrected based on multiple conditions. For example, both temperature and voltage differential may be compensated for in an electronic circuit by receiving the measured value and correcting the value based, in part or in whole, on the temperature and voltage differential. Thus, for example, a method for correcting measurements in a speaker monitoring circuit may include applying compensation for non-linearity of a sense resistor used to obtain the received measurement due to temperature changes of the sense resistor and may include applying compensation for non-linearity of a sense resistor used to obtain the received measurement due to voltage differences across the sense resistor.

In any embodiment involving correction of a measured value, the correction for temperature, voltage differential, or other characteristic may include correcting the measurement based, in part or whole, on at least one predetermined correction factor associated with a component involved in performing the received measurement (such as the $TCR_1$, $TCR_2$, $VCR_1$, and $VCR_2$ factors described below). Further, a corrected value may be reported to a speaker current sense circuit, and the speaker current sense circuit may control an output of a speaker based, in part or whole, on the corrected measurement, such as for speaker protection.

In certain embodiments, the measurement compensation is implemented in an audio controller of an apparatus, wherein the audio controller is configured to couple to a speaker, and wherein the audio controller is configured to perform steps such as monitoring a current through a speaker by receiving a measurement that is correlated to a current output through the speaker and such as correcting the measurement for one or more inaccuracies in the measurement.

In certain embodiments, the measurement compensation is implemented in an apparatus for monitoring a current through a speaker. The apparatus may include an input node configured to couple to a sense resistor coupled in series with the speaker; a current sense monitor coupled to the sense resistor and configured to measure a voltage across the sense resistor that corresponds to the current through the speaker; a correction circuit coupled to the current sense monitor and configured to calculate a correction value; and an output node coupled to the correction circuit and coupled to the current sense monitor, wherein the output node is configured to output a value based, in part or whole, on the measured voltage and the calculated correction value.

The foregoing has outlined rather broadly certain features and technical advantages of embodiments of the present invention in order that the detailed description that follows may be better understood. Additional features and advantages will be described hereinafter that form the subject of the claims of the invention. It should be appreciated by those having ordinary skill in the art that the conception and specific embodiment disclosed may be readily utilized as a basis for modifying or designing other structures for carrying out the same or similar purposes. It should also be realized by those having ordinary skill in the art that such equivalent constructions do not depart from the spirit and scope of the invention as set forth in the appended claims. Additional features will be better understood from the following description when considered in connection with the accompanying figures. It is to be expressly understood, however, that each of the figures is provided for the purpose of illustration and description only and is not intended to limit the present invention.

BRIEF DESCRIPTION OF THE DRAWINGS

For a more complete understanding of the disclosed system and methods, reference is now made to the following descriptions taken in conjunction with the accompanying drawings.

DETAILED DESCRIPTION

Figure 2:
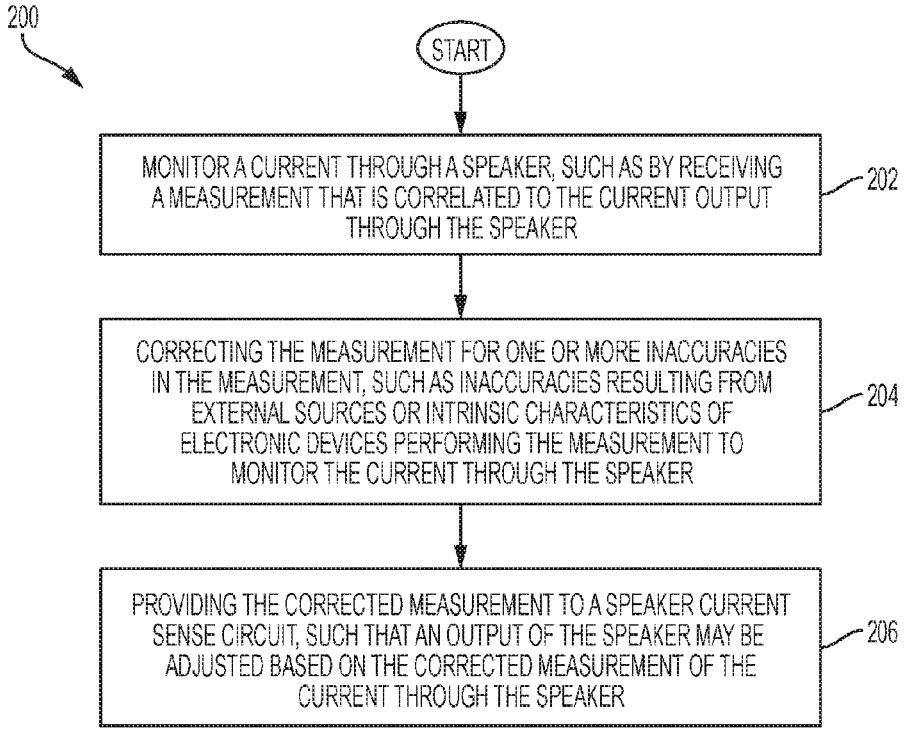
FIG. 2 is a flow chart illustrating an example method for correcting for errors in measurements that occur during speaker monitoring according to one embodiment of the disclosure.

As described above, errors in measurements may be corrected, which may improve the accuracy, performance, or quality of other signals affected by the measurement. One method for correcting such measurements is described with reference to FIG. 2. FIG. 2 is a flow chart illustrating an example method for correcting for errors in measurements that occur during speaker monitoring according to one embodiment of the disclosure. A method 200 may begin at block 202 with monitoring a current through a speaker or other transducer device. The speaker may be monitored by receiving a measurement related to a time-changing characteristic of the speaker. In one embodiment, the measurement may be a voltage measurement or current measurement that is correlated to the current through the speaker. Then, at block 204, the measurement received at block 202 may be corrected for one or more inaccuracies in the measurement. For example, the correction may be applied to correct inaccuracies resulting from external sources or intrinsic characteristics of the electronic devices used to perform the measurement of block 202. Next, at block 206, the corrected measurement of block 204 may be provided to a speaker current sense circuit. The corrected measurement may be used by the sense circuit or a controller to adjust an output of the speaker based on the corrected measurement. For example, a speaker monitor circuit may decrease an energy content of an audio signal when the speaker is in an over-current or over-temperature condition. Although certain examples of speaker monitoring, speaker protection, and other audio adjustments are described herein, the corrected measurement of a current through an electronic component may be used for other applications.

Figure 3:
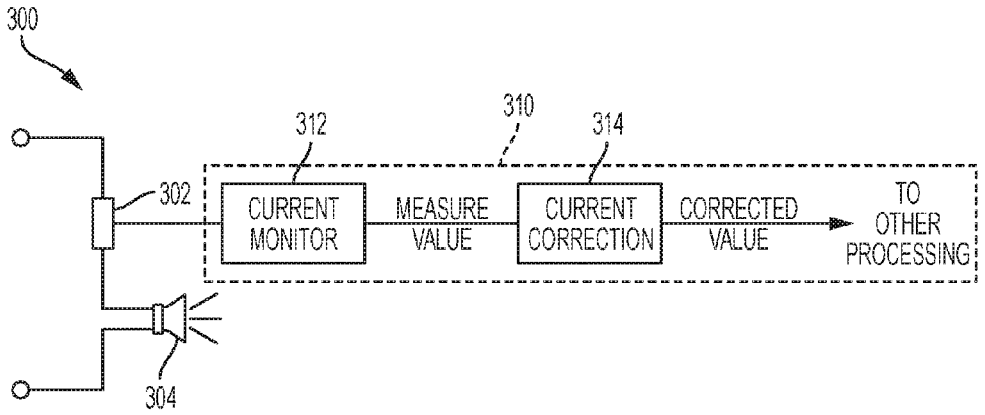
FIG. 3 is a block diagram illustrating an example circuit for correcting for errors in measurements that occur during speaker monitoring according to one embodiment of the disclosure.

One block diagram of a circuit for correction of measurements in a speaker monitoring device is shown in FIG. 3. FIG. 3 is a block diagram illustrating an example circuit for correcting for errors in measurements that occur during speaker monitoring according to one embodiment of the disclosure. A circuit 300 may include a speaker 304 or other transducer coupled in series with a measurement component 302, such as a sense resistor. The sense resistor may be coupled to an audio controller 310 for monitoring and controlling the speaker 304. The audio controller 310 may include a current monitor 312, which measures characteristics of the component 302 such as a voltage across a sense resistor. The current monitor 312 may also include circuitry for performing computations on the measured characteristic, such as converting a measured voltage into a current value. Further, the current monitor 312 may include some memory, such as to store one or more resistance values that may be used in converting the measured voltage into a current value according to the equation I=V/R, where V is the measured voltage and R is a resistance value for the component 302. The current monitor 312 may output a measured value to a current correction block 314. The current correction block 314 may include circuitry to modify the measured value for one or more errors in the measurement caused by the current monitor 312, the measurement component 302, or other external factors. In one embodiment, the current correction block 314 may apply correction for errors in measurements resulting from temperature changes that affect the measurement component 302. In another embodiment, the current correction block 314 may apply correction for errors in measurements resulting from voltage differentials across the measurement component 302. In yet another embodiment, the current correction block 314 may apply correction for multiple sources of errors, such as correcting for temperature changes and voltage differentials that affect the measurement component 302. Although the block diagram illustrates current monitoring through a speaker 304, the circuitry of blocks 302, 312, and 314 may be applied to the measurement of currents of other electronic components.

Figure 1:
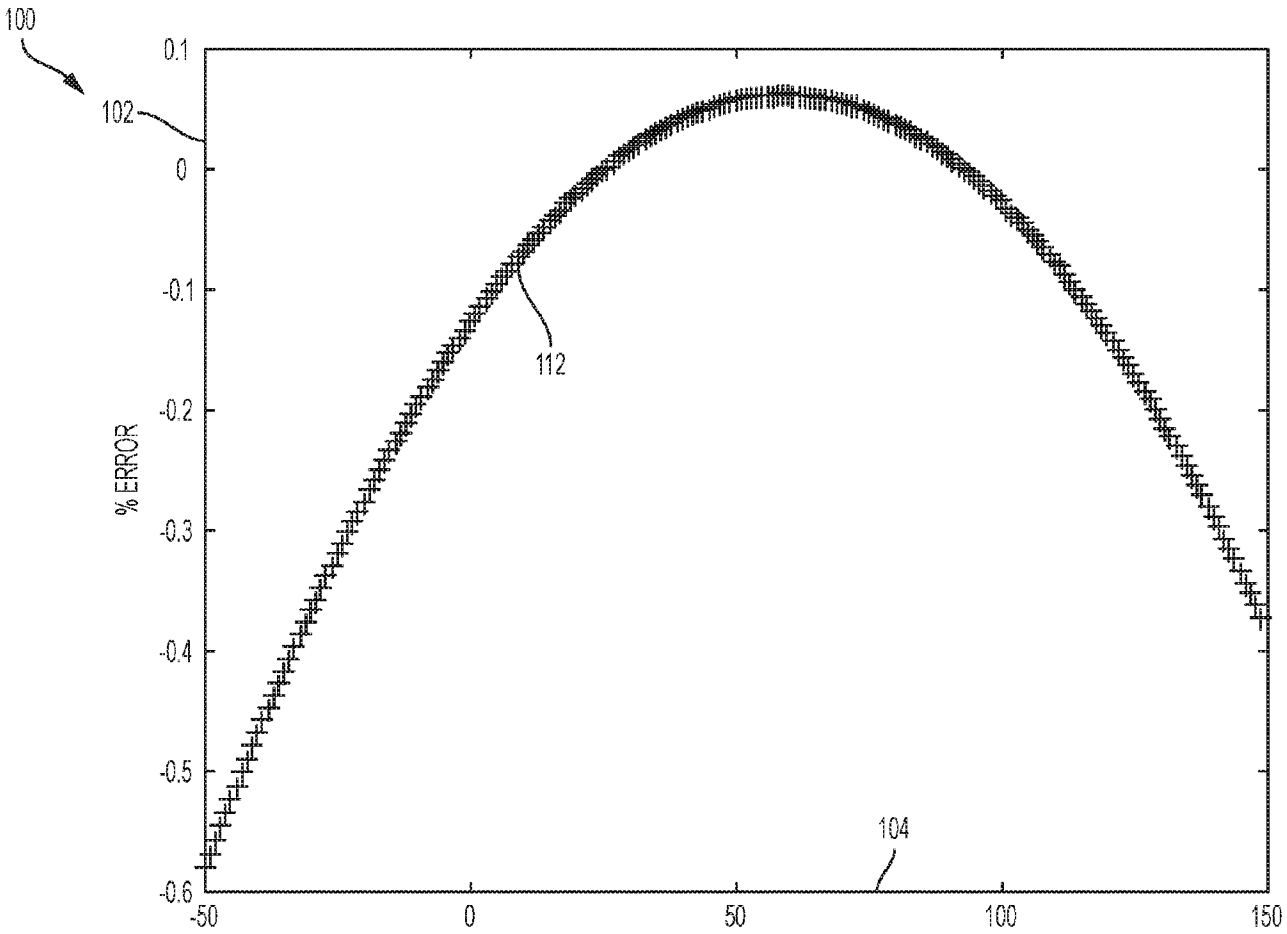
FIG. 1 PRIOR ART
FIG. 1 is a graph illustrating error in measurements involving an example conventional resistor as a function of temperature.
Figure 4:
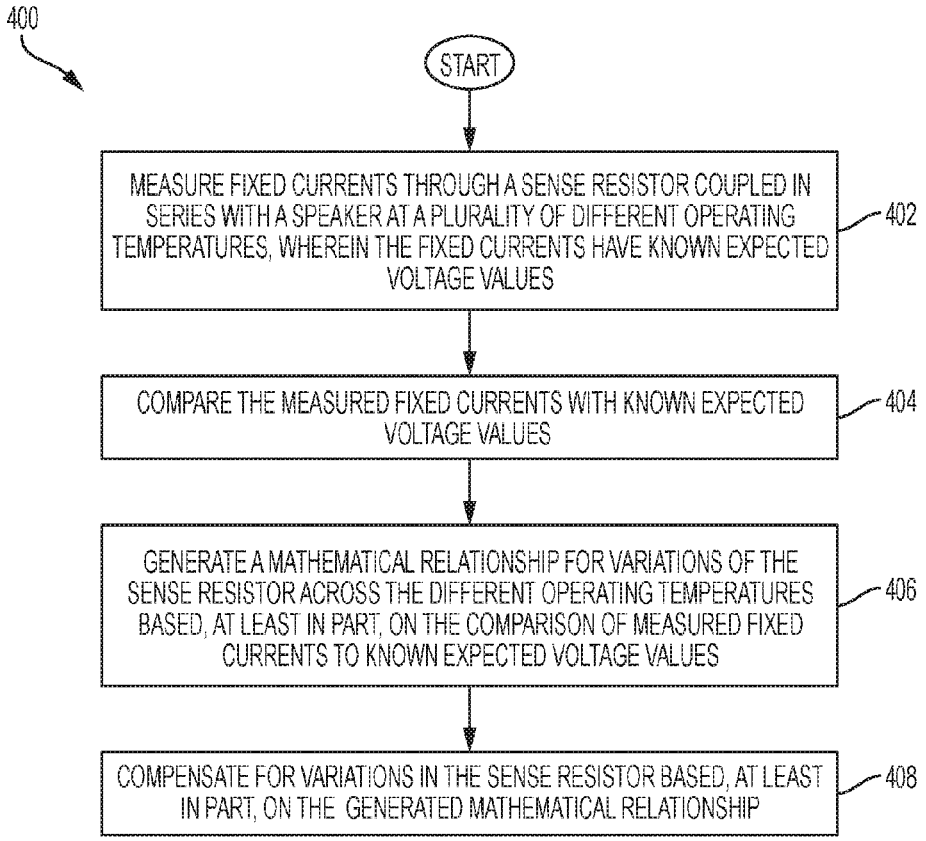
FIG. 4 is a flow chart illustrating an example method for correcting for errors in measurements occurring from temperature variations during speaker monitoring according to one embodiment of the disclosure.

One example correction that may be performed by the current correction block 314 is correction for temperature changes that affect the measurement component 302. For example, when the measurement component 302 is a sense resistor, a resistance of the sense resistor may vary with temperature as described with reference to FIG. 1. The variations with temperature may cause errors in the monitored current. The current correction block 314 may perform operations and/or execute steps that apply corrections for these changes in resistance of the sense resistor and thus improve accuracy of the current monitoring through the speaker 304. One method for such correction is described with reference to FIG. 4. FIG. 4 is a flow chart illustrating an example method for correcting for errors in measurements occurring from temperature variations during speaker monitoring according to one embodiment of the disclosure. A method 400 may begin at block 402 with measuring one or more fixed currents through a sense resistor at a plurality of different operating temperatures. Next, at block 404, the measured fixed currents may be compared with known expected voltage values. Then, at block 406, a mathematical relationship for variations of the sense resistor across the different operating temperatures may be determined. The determination of block 406 may be generated based on a comparison of the measured fixed currents with the known expected voltage values. For example, a mathematical relationship for a measured voltage $V_{meas}$ across the sense resistor as a function of temperature may be determined from $$V_{meas}=i_{spk}*R_0(1+TCR_1\Delta T+TCR_2\Delta T^2)$$

where T is temperature, $i_{spk}$ is a speaker current, $R_0$ is a base resistance value for the sense resistor, and $TCR_1$ and $TCR_2$ are correction factors that may be determined as part of the determination of block 406 to describe the behavior of the sense resistor with respect to changing temperature. Although a second order polynomial equation is shown here, other equations may be used to describe a mathematical relationship of the sense resistor as a function of temperature. The correction factors $TCR_1$ and $TCR_2$ may be stored in a memory of the temperature correction block 514 and subsequently used to correct measurements. The correction factors may be preloaded as predetermined values on a device carrying the correction block 514 or the correction factors may be determined at a start-up or initialization period of the device. A correction value $V_{corr}$ may then be calculated from $$V_{corr}=i_{spk}*R_0(1+TCR_1\Delta T+TCR_2\Delta T^2)(TCR_1\Delta T+TCR_2\Delta T^2)$$

and that $V_{corr}$ value added to the $V_{meas}$ value to obtain a calibrated measurement value $V_{calib}$ to compensate for variations in the sense resistor at block 408. The $V_{calib}$ value may then be used by other circuitry to determine a current through the speaker 304 and/or control the speaker 304 based on the determined current.

Figure 5:
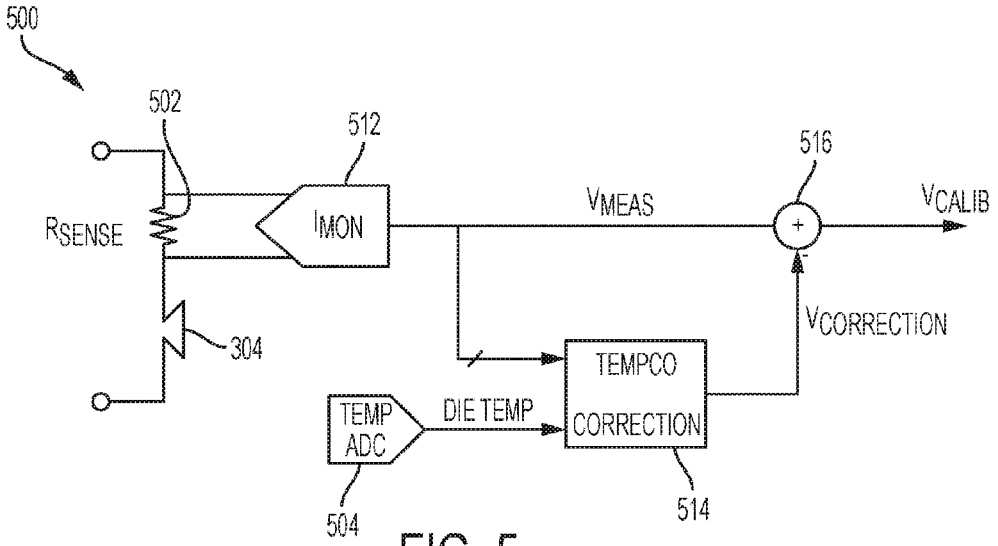
FIG. 5 is a block diagram illustrating an example circuit for correcting for errors in measurements occurring from temperature variations during speaker monitoring according to one embodiment of the disclosure.

An example circuit for implementing correction of current monitoring measurements to reduce variations due to temperature is shown in FIG. 5. FIG. 5 is a block diagram illustrating an example circuit for correcting for errors in measurements occurring from temperature variations during speaker monitoring according to one embodiment of the disclosure. A circuit 500 may include a current monitor 512 coupled to a sense resistor 502 that is coupled in series with the speaker 304. The current monitor 512 may be configured as described with respect to current monitor 312 of FIG. 3 to produce a measured voltage value $V_{meas}$. The measured voltage $V_{meas}$ may be supplied to a temperature correction block 514. The temperature correction block 514 may generate a correction value $V_{corr}$ based on the measured voltage $V_{meas}$ and a measured temperature T received from a temperature sensor through an analog-to-digital converter (ADC) 504. The correction value $V_{corr}$ and the measured voltage $V_{meas}$ may be input to a summation block 516 that adds the two values to generate a calibrated voltage value $V_{calib}$. The calibrated voltage value $V_{calib}$ may provide a better measurement of the current through the speaker 304 by having compensated for at least some of the error in the current measurement caused by characteristics of the sense resistor 502 that change relative to temperature.

Figure 6:
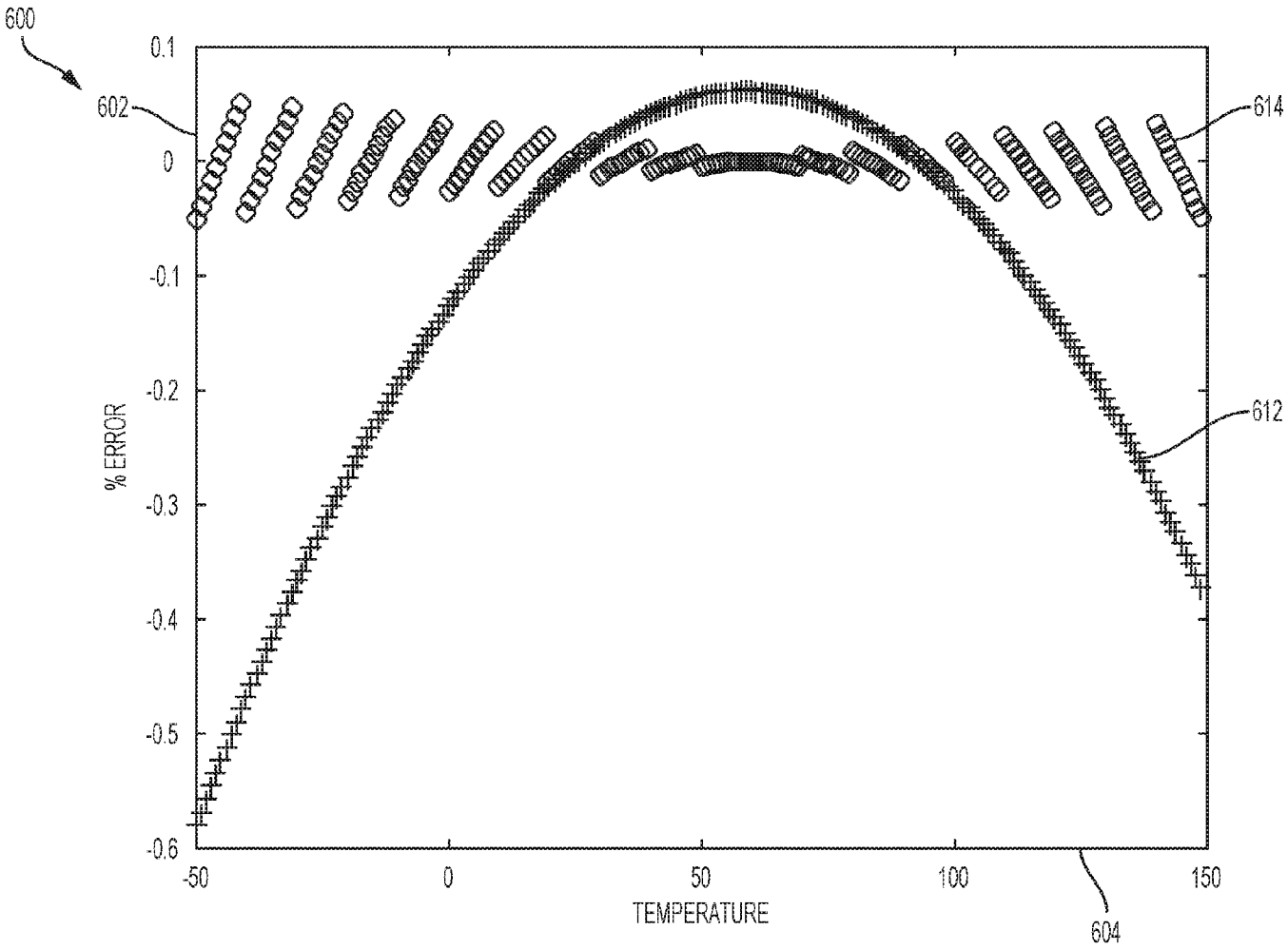
FIG. 6 is a graph illustrating an improvement in accuracy of corrected current measurements according to some embodiments of the disclosure.

One example of the application of the measurement correction producing more accurate results in shown in FIG. 6. FIG. 6 is a graph illustrating an improvement in accuracy of corrected current measurements according to some embodiments of the disclosure. A graph 600 plots error in measurement on y-axis 602 as a function of temperature on x-axis 604. A line 612 shows the uncorrected measured value $V_{meas}$ using a particular sense resistor. After correction according to a process similar to that described with reference to FIG. 4 and FIG. 5, a calibrated measured value $V_{calib}$ is generated and plotted as line 614. As shown, the error amounts for the calibrated values $V_{calib}$ in line 614 are significantly smaller than the error amounts for the uncorrected measured values $V_{meas}$ in line 612. In fact, peak-to-peak error across the temperature range of −50 degrees Celsius to 150 degrees Celsius is reduced from 0.65% for the uncorrected measured values $V_{meas}$ to 0.1% for the calibrated values $V_{calib}$. Further improvements may be possible with more complex equations relating the variations to temperature and more correction factors.

Referring back to FIG. 3, one example correction that may be performed by the current correction block 314 is correction for temperature changes that affect the measurement component 302. Example correction for temperature variations was described above with reference to FIG. 4, FIG. 5, and FIG. 6. Another example correction that may be performed by the current correction block 314 is correction for voltage differentials across the measurement component 302 that affect measurements involving the measurement component 302. For example, when the measurement component 302 is a sense resistor, a resistance of the sense resistor may vary with a voltage difference across terminals of the resistor. The current correction block 314 may perform operations and/or execute steps that apply corrections for these changes in resistance of the sense resistor and thus improve accuracy of the current monitoring through the speaker 304. One method for such correction is described with reference to FIG. 7.

Figure 7:
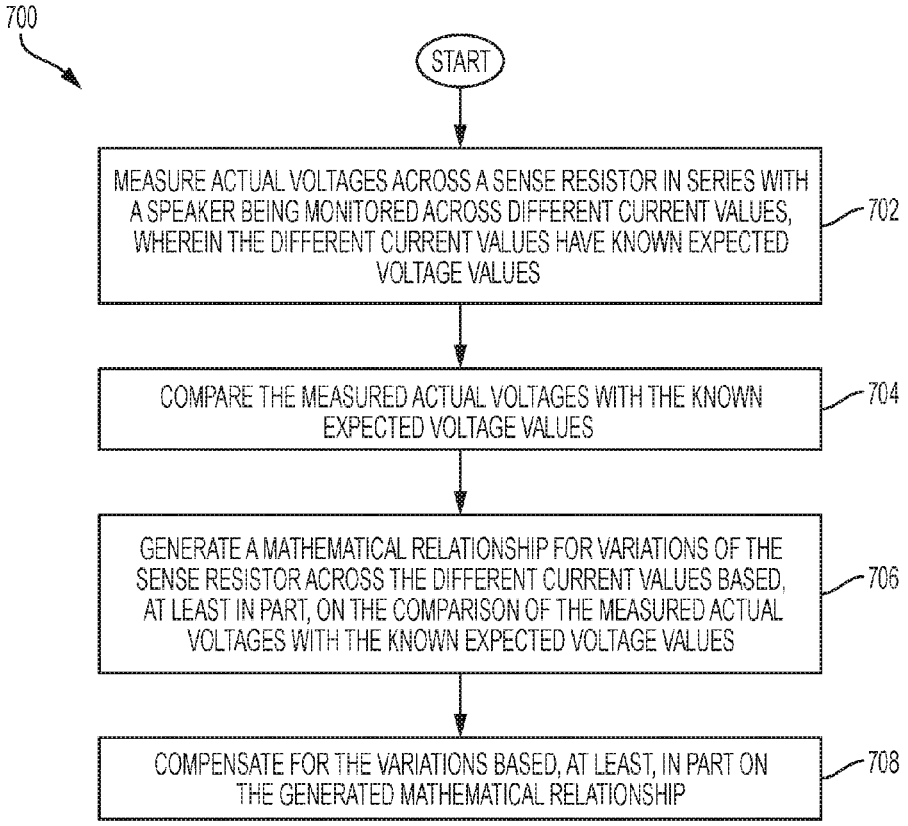
FIG. 7 is a flow chart illustrating an example method for correcting for errors in measurements occurring from voltage variations during speaker monitoring according to one embodiment of the disclosure.

FIG. 7 is a flow chart illustrating an example method for correcting for errors in measurements occurring from voltage variations during speaker monitoring according to one embodiment of the disclosure. A method 700 may begin at block 702 with measuring actual voltages across a sense resistor at different fixed current values. Next, at block 704, the measured actual voltages may be compared with known expected voltage values. Then, at block 706, a mathematical relationship for variations of the sense resistor at different voltage differentials may be determined. The determination of block 706 may be generated based on a comparison of the measured actual voltages with the known expected voltage values. For example, a mathematical relationship for a measured voltage $V_{meas}$ as a function of voltage differential may be determined from $$V_{meas}=i_{spk}*R_0(1+VCR_1V+VCR_2V^2)$$

where V is a measured actual voltage, $i_{spk}$ is a speaker current, $R_0$ is a base resistance value for the sense resistor, and $VCR_1$ and $VCR_2$ are coefficients that may be determined as part of the determination of block 406 to describe the behavior of the sense resistor with respect to voltage differential across the sense resistor. Although a second order polynomial equation is shown here, other equations may be used to describe a mathematical relationship of the sense resistor as a function of voltage differential. The correction factors $VCR_1$ and $VCR_2$ may be stored in a memory of the temperature correction block 714 and subsequently used to correct measurements. The correction factors may be preloaded as predetermined factors on a device containing the correction block 714 or the correction factors may be determined at a start-up or initialization period of the device. A correction value $V_{corr}$ may then be calculated from $$V_{corr}=V_{meas}(VCR_1V_{meas}+VCR_2V_{meas}^2)$$

and that $V_{corr}$ value added to the $V_{meas}$ value to obtain a calibrated measurement value $V_{calib}$ to compensate for variations in the sense resistor at block 708. The $V_{calib}$ value may then be used by other circuitry to determine a current through the speaker 304.

Figure 8:
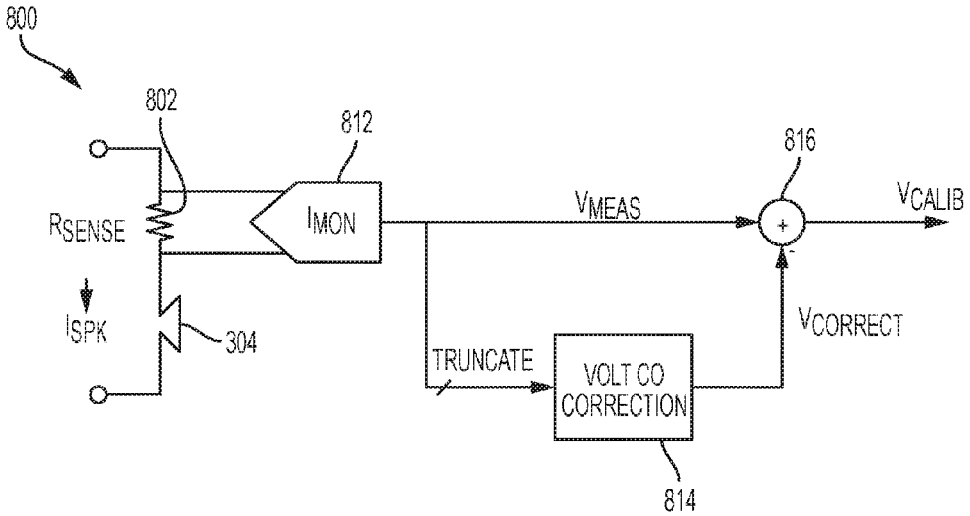
FIG. 8 is a block diagram illustrating an example circuit for correcting for errors in measurements occurring from voltage variations during speaker monitoring according to one embodiment of the disclosure.

An example circuit for implementing correction of current monitoring measurements to reduce variations due to temperature is shown in FIG. 8. FIG. 8 is a block diagram illustrating an example circuit for correcting for errors in measurements occurring from voltage variations during speaker monitoring according to one embodiment of the disclosure. A circuit 800 may include a current monitor 812 coupled to a sense resistor 802 that is coupled in series with the speaker 304. The current monitor 812 may be configured as described with respect to current monitor 312 of FIG. 3 to produce a measured voltage value $V_{meas}$. The measured voltage $V_{meas}$ may be supplied to a voltage correction block 814. In some embodiments, the $V_{meas}$ value may be truncated, such as to three bits, to reduce the complexity of computations performed in the voltage correction block 814. For example, the voltage correction block 814 may be digital circuitry, and a reduction in the number of input bits may proportionally decrease the size of the logic circuitry for processing the $V_{meas}$ value. The voltage correction block 814 may generate a correction value $V_{corr}$ based on the measured voltage $V_{meas}$ received from the current monitor 812. The correction value $V_{corr}$ and the measured voltage $V_{meas}$ may be input to a summation block 816 that adds the two values to generate a calibrated voltage value $V_{calib}$. The calibrated voltage value $V_{calib}$ may provide a better measurement of the current through the speaker 304 by having compensated for at least some of the error in the current measurement caused by characteristics of the sense resistor 802 that change relative to voltage differential.

Figure 9:
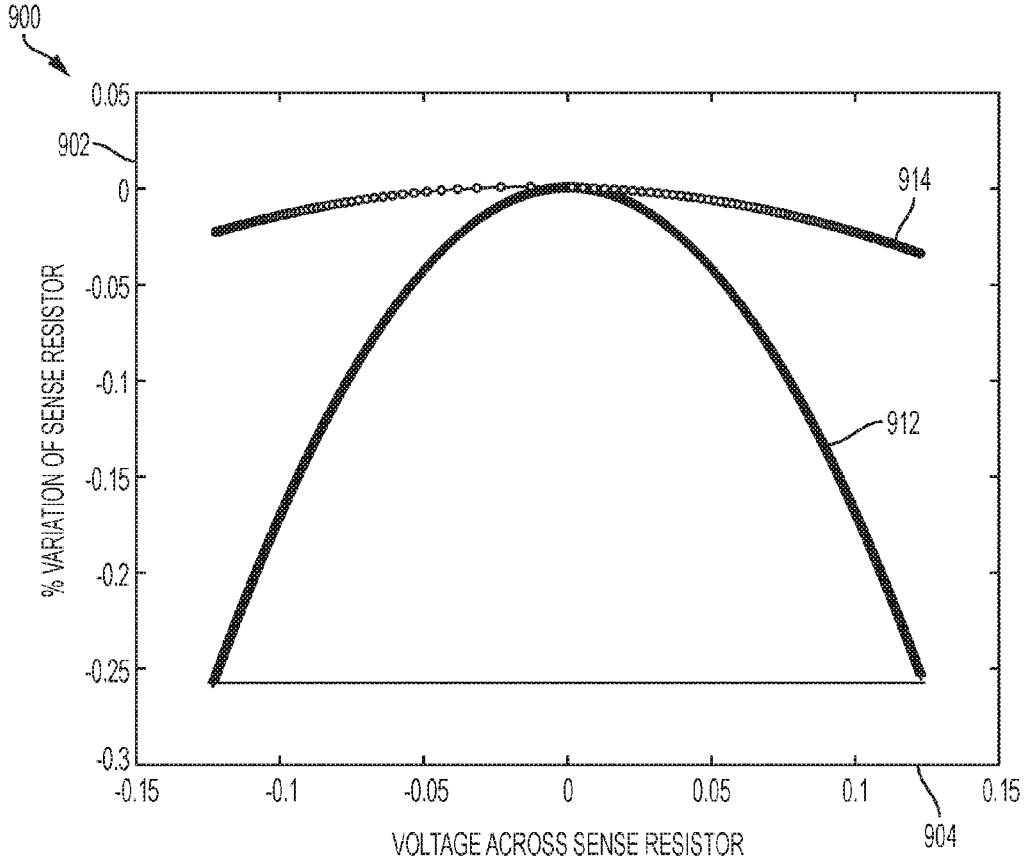
FIG. 9 is a graph illustrating an improvement in accuracy of corrected current measurements according to some embodiments of the disclosure.

One example of the application of the measurement correction producing more accurate results is shown in FIG. 9. FIG. 9 is a graph illustrating an improvement in accuracy of corrected current measurements according to some embodiments of the disclosure. A graph 900 plots error in measurement on y-axis 902 as a function of voltage different on x-axis 904. A line 912 shows the uncorrected measured value $V_{meas}$ using a particular sense resistor. After correction according to a process similar to that described with reference to FIG. 7 and FIG. 8, a calibrated measured value $V_{calib}$ is generated and plotted as line 914. As shown, the error amounts for the calibrated values $V_{calib}$ in line 914 are significantly smaller than the error amounts for the uncorrected measured values $V_{meas}$ in line 912. In fact, total harmonic distortion (THD) across the voltage differential range of −0.15 Volts to +0.15 Volts is reduced from −63 dB for the uncorrected measured values $V_{meas}$ to −83 dB for the calibrated values $V_{calib}$. Further improvements may be possible with more complex equations relating the variations to voltage differential and more correction factors.

Figure 10:
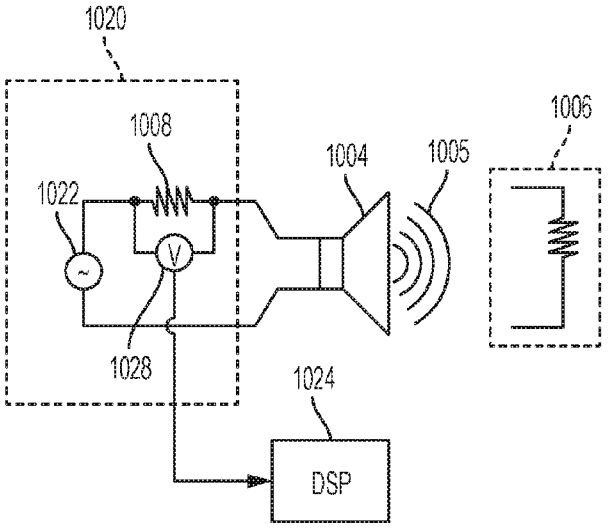
FIG. 10 is a block diagram illustrating speaker impedance monitoring with corrected current measurements according to one embodiment of the disclosure.

One apparatus for measuring a speaker impedance includes a resistor for measuring current. FIG. 10 is a block diagram illustrating speaker impedance monitoring according to one embodiment of the disclosure. The speaker 1004 may be coupled to a voltage source 1022 of the amplifier 1020. The speaker 1004 may have an impedance 1006 proportional to loading of the acoustic sound field 1005. A resistor 1008 may be coupled in series with the speaker 1004, such that a current passing through the resistor 1008 is proportional to a current passing through the speaker 1004. A voltmeter 1028 may be coupled in parallel with the resistor 1008 to measure a voltage across the resistor 1008. The voltmeter 1028 is one example of or a part of the current monitor 312. The current passing through the resistor 1008, and thus the speaker 1004, may be calculated by multiplying the resistance value of the resistor 1008 with a calibrated value obtained from applying embodiments of the invention to an output of the voltmeter 1028. The current may be calculated by an audio controller or processor, such as a digital signal processor 1024 or fixed circuitry. The impedance 1006 of the speaker 1004 may be calculated, by the processor 1024, from the voltage value at the voltage source 1022, the resistance value of the resistor 1008, and the calibrated voltage corrected for inaccuracies in measurements of the sense resistor 1008, such as described in embodiments of FIG. 2, FIG. 3, FIG. 4, FIG. 5, FIG. 7, and FIG. 8 above.

Using the corrected measurement value from an electronic component, such as sense resistor 1008 of FIG. 10, the processor 1024 may control an output of the speaker 1004. For example, the processor 1024 may adjust a magnitude of the voltage source 1022 driving the speaker 1004 to reduce the likelihood of an over-current condition or return the speaker 1004 to normal operation from an over-current condition. Similarly, the processor 1024 may adjust the voltage source 1022 to reduce the likelihood of an over-temperature condition of the speaker 1004 or return the speaker 1004 to normal operation from an over-temperature condition. As another example, the processor 1024 may monitor current through the speaker to determine an impedance 1006 of the speaker 1004 and thus determine characteristics of the environment in the vicinity of the sound field 1005. The environmental characteristics may be used to detect whether a mobile device containing the speaker 1004 is on-ear or off-ear and control the voltage source 1022 and/or control an adaptive noise cancellation (ANC) algorithm appropriately, such as described in U.S. patent application Ser. No. 15/195,785 entitled "Speaker Impedance Monitoring," which is incorporated by reference. In some of these examples, the processor 124 may adjust an output of the speaker based 1004 based on the corrected measurement of speaker current from the sense resistor 1008.

The schematic flow chart diagrams of FIG. 2, FIG. 4, and FIG. 7 are generally set forth as a logical flow chart diagram. As such, the depicted order and labeled steps are indicative of aspects of the disclosed method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagram, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

The operations described above as performed by a processor or controller may be performed by any circuit configured to perform the described operations. Such a circuit may be an integrated circuit (IC) constructed on a semiconductor substrate and include logic circuitry, such as transistors configured as logic gates, and memory circuitry, such as transistors and capacitors configured as dynamic random access memory (DRAM), electronically programmable read-only memory (EPROM), or other memory devices. The logic circuitry may be configured through hard-wire connections or through programming by instructions contained in firmware. Further, the logic circuitry may be configured as a general purpose processor capable of executing instructions contained in software. If implemented in firmware and/or software, functions described above may be stored as one or more instructions or code on a computer-readable medium. Examples include non-transitory computer-readable media encoded with a data structure and computer-readable media encoded with a computer program. Computer-readable media includes physical computer storage media. A storage medium may be any available medium that can be accessed by a computer. By way of example, and not limitation, such computer-readable media can comprise random access memory (RAM), read-only memory (ROM), electrically-erasable programmable read-only memory (EEPROM), compact disc read-only memory (CD-ROM) or other optical disk storage, magnetic disk storage or other magnetic storage devices, or any other medium that can be used to store desired program code in the form of instructions or data structures and that can be accessed by a computer. Disk and disc includes compact discs (CD), laser discs, optical discs, digital versatile discs (DVD), floppy disks and Blu-ray discs. Generally, disks reproduce data magnetically, and discs reproduce data optically. Combinations of the above should also be included within the scope of computer-readable media.

In addition to storage on computer readable medium, instructions and/or data may be provided as signals on transmission media included in a communication apparatus. For example, a communication apparatus may include a transceiver having signals indicative of instructions and data. The instructions and data are configured to cause one or more processors to implement the functions outlined in the claims.

Although the present disclosure and certain representative advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. For example, although analog-to-digital converters (ADCs) are described throughout the detailed description, aspects of the invention may be applied to the design of other converters, such as digital-to-analog converters (DACs) and digital-to-digital converters, or other circuitry and components based on delta-sigma modulation. As another example, although digital signal processors (DSPs) are described throughout the detailed description, aspects of the invention may be applied to the design of other processors, such as graphics processing units (GPUs) and central processing units (CPUs). Further, although speakers and transducers are described, current monitoring and the related methods and apparatuses described herein may be applied to monitoring of other devices without change in operation of the processor described in embodiments above. As another example, although processing of audio data is described, other data may be processed through the circuitry described above. As one of ordinary skill in the art will readily appreciate from the present disclosure, processes, machines, manufacture, compositions of matter, means, methods, or steps, presently existing or later to be developed that perform substantially the same function or achieve substantially the same result as the corresponding embodiments described herein may be utilized. Accordingly, the appended claims are intended to include within their scope such processes, machines, manufacture, compositions of matter, means, methods, or steps.

What is claimed is:

1. A method, comprising:

monitoring, by a controller, a current through a speaker by receiving a measurement that is correlated to the current output through the speaker; and correcting, by the controller, the measurement for one or more inaccuracies in the measurement due to variations of a sense resistor, coupled to the speaker and used for obtaining the measurement, that are caused by temperature changes resulting in variations of resistance of the sense resistor, wherein the step of correcting the measurement for one or more inaccuracies comprises applying compensation for non-linearity of a sense resistor used to obtain the received measurement due to variations of the sense resistor caused by temperature changes.

2. The method of claim 1, wherein the step of correcting the measurement for one or more inaccuracies in the measurement comprises steps comprising:

measuring fixed currents through the resistor across different operating temperatures, wherein the fixed currents have known expected voltage values;

comparing the measured fixed currents with known expected voltage values;

generating a mathematical relationship for variations of the sense resistor across the different operating temperatures of the sense resistor based, at least in part, on the comparing step; and compensating for the variations based, at least in part, on the generated mathematical relationship.

3. The method of claim 1, wherein the step of correcting the measurement for one or more inaccuracies comprises applying compensation for non-linearity of a sense resistor used to obtain the received measurement due to variations of the sense resistor caused by voltage differentials.

4. The method of claim 3, wherein the step of correcting the measurement for one or more inaccuracies in the measurement comprises steps comprising:

measuring actual voltages across the sense resistor across different currents, wherein the different currents have known expected voltage values;

comparing the measured actual voltages with the known expected voltage values;

generating a mathematical relationship for variations of the sense resistor across the different currents through the sense resistor based, at least in part, on the comparing step; and compensating for the variations based, at least in part, on the generated mathematical relationship.

5. The method of claim 1, wherein the step of correcting the measurement for one or more inaccuracies comprises:

applying compensation for non-linearity of a sense resistor used to obtain the received measurement due to temperature changes of the sense resistor; and applying compensation for non-linearity of a sense resistor used to obtain the received measurement due to voltage differences across the sense resistor.

6. The method of claim 1, wherein the step of correcting the measurement for one or more inaccuracies comprises correcting the measurement based, at least in part, on at least one predetermined correction factor associated with a component involved in performing the received measurement.

7. The method of claim 1, further comprising reporting the corrected measurement to a speaker current sense circuit, wherein the speaker current sense circuit controls an output of the speaker based, at least in part, on the corrected measurement to provide speaker protection.

8. An apparatus, comprising:

an audio controller configured to couple to a speaker, wherein the audio controller is configured to perform steps comprising:

monitoring, by the audio controller, a current through a speaker by receiving a measurement that is correlated to a current output through the speaker; and correcting, by the audio controller, the measurement for one or more inaccuracies in the measurement due to variations of a sense resistor, coupled to the speaker and used for obtaining the measurement, that are caused by temperature changes resulting in variations of resistance of the sense resistor, wherein the step of correcting the measurement for one or more inaccuracies comprises applying compensation for non-linearity of a sense resistor used to obtain the received measurement due to variations of the sense resistor caused by temperature changes.

9. The apparatus of claim 8, wherein the step of correcting the measurement for one or more inaccuracies in the measurement comprises steps comprising:

measuring fixed currents through the resistor across different operating temperatures, wherein the fixed currents have known expected voltage values;

comparing the measured fixed currents with known expected voltage values;

generating a mathematical relationship for variations of the sense resistor across the different operating temperatures of the sense resistor based, at least in part, on the comparing step; and compensating for the variations based, at least in part, on the generated mathematical relationship.

10. The apparatus of claim 8, herein the step of correcting the measurement for one or more inaccuracies comprises applying compensation for non-linearity of a sense resistor used to obtain the received measurement due to variations of the sense resistor caused by voltage differentials.

11. The apparatus of claim 10, wherein the step of correcting the measurement for one or more inaccuracies in the measurement comprises steps comprising:

measuring actual voltages across the sense resistor across different currents, wherein the different currents have known expected voltage values;

comparing the measured actual voltages with the known expected voltage values;

generating a mathematical relationship for variations of the sense resistor across the different currents through the sense resistor based, at least in part, on the comparing step; and compensating for the variations based, at least in part, on the generated mathematical relationship.

12. The apparatus of claim 8, wherein the step of correcting the measurement for one or more inaccuracies comprises:

applying compensation for non-linearity of a sense resistor used to obtain the received measurement due to temperature changes of the sense resistor; and applying compensation for non-linearity of a sense resistor used to obtain the received measurement due to voltage differences across the sense resistor.

13. The apparatus of claim 8, wherein the step of correcting the measurement for one or more inaccuracies comprises correcting the measurement based, at least in part, on at least one predetermined correction factor associated with a component involved in performing the received measurement.

14. The apparatus of claim 8, wherein the audio controller is further configured to perform steps comprising reporting the corrected measurement to a speaker current sense circuit, wherein the speaker current sense circuit controls an output of the speaker based, at least in part, on the corrected measurement to provide speaker protection.

15. An apparatus for monitoring a current through a speaker, comprising:

an input node configured to couple to a sense resistor coupled in series with the speaker;

a current sense monitor coupled to the sense resistor and configured to measure a voltage across the sense resistor that corresponds to the current through the speaker;

a correction circuit coupled to the current sense monitor and configured to calculate a correction value to compensate for variations of the sense resistor caused by temperature changes resulting in variations of resistance of the sense resistor, wherein the correction circuit comprises circuitry configured to perform steps comprising applying compensation for non-linearity of the sense resistor used to obtain the received measurement due to variations of the sense resistor caused by temperature changes;

an output node coupled to the correction circuit and coupled to the current sense monitor, wherein the output node is configured to output a value based, at least in part, on the measured voltage and the calculated correction value; and a speaker current sense circuit coupled to the output node and configured to control an output of the speaker based, at least in part, on the corrected measurement to provide speaker protection.

16. The apparatus of claim 15, wherein the apparatus further comprises:

a temperature sensor configured to measure a die temperature in a proximity of the sense resistor; and an analog-to-digital converter (ADC) coupled to the temperature sensor and coupled to the correction circuit, wherein the correction circuit is configured to apply temperature compensation to the received measurement based, at least in part, on the measured die temperature.

17. The apparatus of claim 15, wherein the correction circuit comprises circuitry configured to perform steps comprising applying compensation for non-linearity of the sense resistor used to obtain the received measurement due to variations of the sense resistor caused by voltage differentials.

* * * * *